US006598916B2

(12) United States Patent
Miyazawa

(10) Patent No.: US 6,598,916 B2
(45) Date of Patent: Jul. 29, 2003

(54) SPREADER FOR CONTAINER CRANE

(75) Inventor: Isao Miyazawa, Urawa (JP)

(73) Assignee: Ishikawajima-Harima Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/226,350

(22) Filed: Aug. 23, 2002

(65) Prior Publication Data

US 2003/0025346 A1 Feb. 6, 2003

Related U.S. Application Data

(62) Division of application No. 09/720,827, filed as application No. PCT/JP99/02686 on May 21, 1999, now Pat. No. 6,502,879.

(51) Int. Cl.[7] ..... B66C 1/10
(52) U.S. Cl. ..... 294/81.21; 294/81.53
(58) Field of Search ..... 294/81.1, 81.2, 294/81.21, 81.53, 67.1, 67.33

(56) References Cited

U.S. PATENT DOCUMENTS 3,874,719 A 4/1975 Goyarts
4,471,989 A * 9/1984 Taylor ..... 294/81.21
4,630,855 A 12/1986 Bjurling

FOREIGN PATENT DOCUMENTS

| | | | | |
|---|---|---|---|---|
| AU | 19783 | * | 2/1977 | ..... 294/81.21 |
| DE | 41 18 524 | | 12/1992 | |
| EP | 0 732 298 | | 9/1996 | |
| JP | 4-80200 | * | 3/1992 | ..... 294/81.21 |
| SU | 1253-937 | * | 2/1986 | ..... 294/81.21 |

* cited by examiner

*Primary Examiner*—Dean J. Kramer
(74) *Attorney, Agent, or Firm*—Oblon, Spivak, McClelland, Maier & Neustadt, P.C.

(57) ABSTRACT

A stationary frame is in the form of a box body by which mutually telescopic lateral extension frames are slidably supported, thereby providing a spreader which is light in weight and has no bent or torsion of the extension frames. Support of the extension frames by the support rollers mounted on the opposite ends of the stationary frame reduces the drive force upon extension or contraction of the extension frames, and provision of the rail and cushioning member between the extension frames and the stationary frame reduces the impact load applied on the extension frames when the spreader is hoisted down onto the container.

1 Claim, 14 Drawing Sheets

SPREADER FOR CONTAINER CRANE

This application is a Divisional of U.S. patent application Ser. No. 09/720,827, filed Jan. 16, 2001, now U.S. Pat. No. 6,502,879, which was a National Stage Application of PCT Application No. PCT/JP99/02686 filed May 21, 1999, the entire contents of which are incorporated herein by reference in their entirety.

FIELD OF THE INVENTION

The present invention relates to a spreader for a container crane.

DISCUSSION OF THE BACKGROUND

FIG. 1 is a schematic side elevation showing a conventional general container crane in which reference numeral 1 denotes a container ship moored at a quay 2 to and from which a container 4 is loaded and unloaded by the container crane 3.

The container crane 3 comprises legs 6 on rails 5 for running along the quay 2, girders 7 atop of the legs 6 and extending substantially horizontally to protrude toward the sea, traverse rails 8 extending along the girders 7 and a trolley 9 for movement in traverse direction.

The trolley 9 comprises, as shown in FIGS. 2 and 3, a trolley body 11 with traverse wheels 12 for rolling on the traverse rails 8. Tied to the trolley body 11 are opposite ends of a traverse rope 13 which is wound around a traverse drum (not shown) in a machine room 10 (see FIG. 1) and which extends under tension longitudinally of the girders 7. Rotation of the traverse drum in normal or reverse direction causes the trolley 9 to be moved in traverse direction.

The trolley 9 has a head block 15 suspended from the trolley 9 through hoisting ropes 14 which in turn are wound around a hoist drum (not shown) in the machine room 10 and which extend under tension longitudinally of the girder 7. Rotation of the hoist drum in normal or reverse direction causes the head block 15 to be hoisted up or down.

Detachably interlocked with the head block 15 through twist locks 17 is a spreader 16 which grips the container 4.

The twist lock 17 comprises a lock pin 19 adapted to be inserted into a slot on an upper surface of the suspender 18 of the spreader 16 and adapted to be twisted for example by a hydraulic cylinder for interlock of the head block 15 with the spreader 16.

The conventional spreader 16 comprises, as shown in FIGS. 1, 3 and 4, extension frames 21 and 22 which are respectively fixed by retainers 21' and 22' to respective parallel portions of an endless chain 26 which in turn extends under tension longitudinally of the stationary frame 20. The chain 26 is driven by a drive 27 to extend or contract the lateral extension frames 21 and 22 in unison laterally or perpendicularly of the traverse direction of the trolley 9. Such extension or contraction of the extension frames 21 and 22 allow a variety of containers 4 with different lengths to be suspended.

Each of the extension frames 21 and 22 has, at its tip, twist locks 23 constructed similarly of the twist locks 17 of the head block 15 to grip the container 4 as well as guide arms 24 for positioning the twist locks 23 for engagement with the container 4. The guide arm 24 can be swung from an upper, turned-over open position into a position for engagement with a corner of the container 4 by actuation of a hydraulic motor 25. This will ensure that the spreader 16 can be correctly positioned to the container 4 and that the twist locks 23 can be positively engaged with the container 4 even if there may be some deviation in lowering the spreader 16 interlocked with the head block 15 onto the container 4 for hoisting of the container 4.

Each of the extension frames 21 and 22 of the conventional spreader 16 comprises, as shown in FIGS. 4 and 5, two frames each with a vertically elongated rectangular section, the two frames being spaced apart from and connected with each other widthwise of the stationary frame 20. The extension frames 21 and 22 are supported by sliders 21*a*, 21*b*, 22*a* and 22*b* (FIG. 5) such that they may brush past with each other with respect to the stationary frame 20. The extension frames 21 and 22 may be I-shaped frames other than the vertically elongated rectangular frames as shown in FIG. 5.

Generally, the container 4 is loaded onto the container ship 1, using the container crane 3, by the following sequence of operations. Firstly, the spreader 16 interlocked with the head block 15 from the trolley 9 is hoisted down onto the container 4. The rock pins 19 of the twist locks 23 are then inserted into slots on an upper surface of the container 4 and are twisted for example by a hydraulic cylinder to interlock the spreader 16 with the container 4. In this state, the head block 15 and spreader 16 are hoisted up and the trolley 9 is moved in traverse direction to a target position above the container ship 1. Then, the head block 15 and spreader 16 are hoisted down to place the container 4 onto the container ship 1.

In such container crane 3, the container 4 often has a predetermined destination. In such a case, with the destination of the container 4 being set, the trolley 9 may be automatically moved in traverse direction; and only hoisting-up and -down of the spreader 16 interlocked with the head block 15 may be manually carried out by an operator in an operation room 36.

However, the above-mentioned conventional spreader for the container crane has following various problems.

The spreader 16 tends to be damaged since generally the spreader 16 is collided with and placed onto the container 4 when the spreader 16 interlocked with the head block 15 is to be hoisted down onto the container 4 for connection of the spreader 16 with the container 4. More specifically, when the spreader 16 is hoisted down, only tip ends of the extension frames 21 and 22 contact the upper surface of the container 4, resulting in cantilever relationship of the extension frames 21 and 22 to the stationary frame 20. This means that when heavy weight (for example over 10 tons) of the head block 15 and spreader 16 acts on the extension frames 21 and 22 upon the collision, the extension frames 21 and 22 will receive extreme bending load which is, for example, 3 or 4 times as large as that received upon hoisting of the container 4. The conventional spreader 16, thus, tends to have damages such as bending of the extension frames 21 and 22. Bending of the extension frames 21 and 22 requires repairing since it disables the extension frames 21 and 22 from being slidingly extended or contracted and shortens the service life of the spreader 16.

In the conventional spreader 16, the lateral extension frames 21 and 22 are unaligned or out of alignment in their lateral axes as shown in FIGS. 4 and 5 so that the extension frames 21 and 22 may be twisted due to any eccentric or torsion load applied when the container 4 is hoisted by the spreader 16.

In order to prevent such bent and/or twist of the extension frames 21 and 22, the spreader 16 must be large in size and/or the stationary and extension frames 20, 21 and 22 must have increased thickness. However, these will inevitably cause increase in weight of the spreader 16, resulting in increase of electric power required for hoisting of the container crane as well as increase of operation cost.

It has been also conventionally envisaged that the stationary and extension frames 20, 21 and 22 have box-shaped sections for enhancement of their sectional strength. However, such box-shaped sections will not allow the extension frames 21 and 22 to be brushed against with each other as shown in FIGS. 4 and 5; and the extension frames can hardly be extended or contracted with greater stroke depending upon variation in length of the containers. Devised out to overcome this problem were lateral extension frames in the form of two-step extendable (telescopic) structure.

However, such lateral extension frames in the form of two-step extendable structure have been proved to be impracticable since the extension frames may be greatly bent and/or bowed and fail to retain their sufficient strength when the container is hoisted.

Furthermore, in the conventional spreaders 16, the extension frames 21 and 22 are slidably supported on the stationary frame 20 so as to be extended or contracted depending upon size of the container 4. More specifically, the stationary frame 20 supports the extension frames 21 and 22 via slide bearings (flat metal bushes).

As a result, friction coefficient between the stationary frame 20 and extension frames 21 and 22 is so large that greater friction force will be generated upon relative slide movement between them, which will necessitate increase in driving force of the drive 27, resulting in necessity of providing the drive 27 with greater rating. Thus, cost increase will be caused from aspects of both product price and electric power consumed. Contact surfaces between the stationary frame 20 and extension frames 21 and 22 must be machined with higher plane accuracy, resulting in increase in machining cost.

The present invention was made in view of the above and has its object to provide a spreader for a container crane which is light in weight, is free from bent and twist of extension frames, can reduce drive force required for extension or contraction of the extension frames and can relieve impact load applied to the extension frames of the spreader when the spreader is hoisted down onto a container.

SUMMARY OF THE INVENTION

A box body with a box-shaped section is provided with laterally extendable telescopic inner and outer box frames. This will drastically enhance bending rigidity of the inner and outer box frames in comparison with conventional spreaders. Moreover, because of telescopic type, the inner and outer box frames are aligned in their lateral axes to prevent twisting load from being applied on the inner and outer box frames, thereby enhancing the strength of the spreader to relieve any possible damages and to prolong the service life of the spreader.

The inner box frame is slidably supported in an end of the box body by inner supports arranged above and below of lateral axis of the inner box frame; and the outer box frame is supported in the other end of the box body by side supports arranged above and below and symmetrically of lateral axis of the outer box frame. The inner and outer box frames can be extended or contracted with greater stroke and with no mutual interference since notches are respectively formed on a top and a bottom of the outer box frame at its base end supported by the box body.

A stationary frame has lateral open ends each of which has at its lower portion support rollers each of which in turn accommodates a bearing and serves for receiving load of the corresponding lateral extension frame. This allows the support rollers to be in rolling contact with the extension frames upon extension or contraction of the extension frames so that only rolling friction is produced between them, resulting in drastic reduction of the drive force for extension or contraction of the extension frames.

The support roller is rotatably supported by arms each of which has one end pivotally supported by the stationary frame and the other open end rotatably supporting the support roller. The arm is kept urged upwardly by urge means such as a helical spring, a torsion bar or a blade spring. The urging force is set to an extent such that the support roller may push up the extension frame to receive the load of the extension frame and that the support roller may escape downwardly when the load of the container is applied. Thus, the support roller will have no greater load applied upon suspension of the container, preventing the support roller from being damaged.

The stationary frame has, at its surface facing to a surface of the extension frames, a rail which extends in the direction of extension and contraction of the extension frames. The extension frame has a rubber or other cushioning member and a slide fitting which rests on the cushioning member and is engaged with the extension frame so as to be fitted over the rail and relatively displaced thereto. Thus, the slide fitting is relatively displaced in guidance of the rail upon extension or contraction of the extension frames, and greater collision force received by the extension frames upon collision of the spreader with the container is absorbed by the cushioning members.

DESCRIPTION OF THE PREFERRED EMBODIMENT

Now, embodiments of the invention will be described in conjunction with the drawings.

Figure 6:
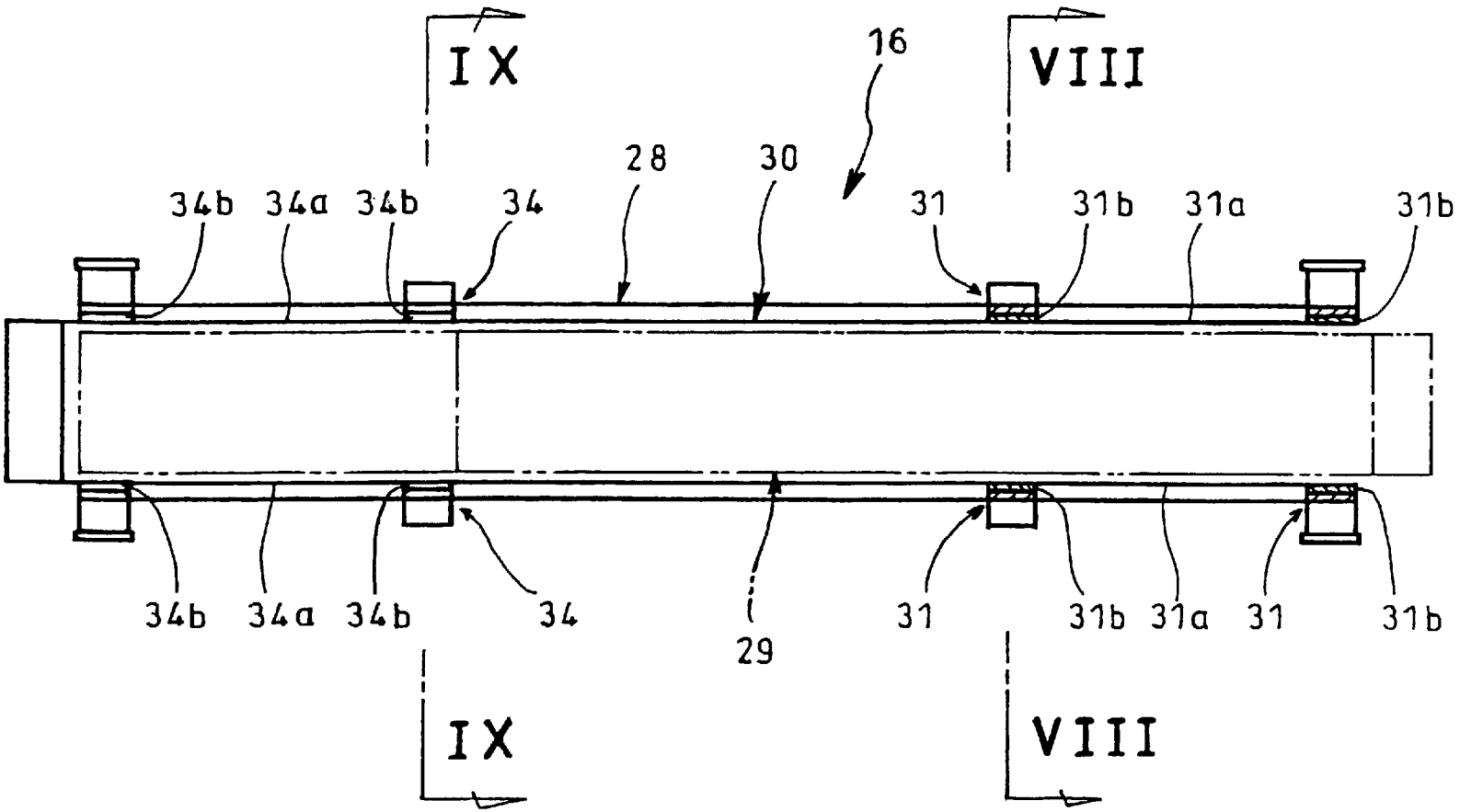
FIG. 6 is a sectional front elevation of an embodiment of a spreader according to the invention.
Figure 7:
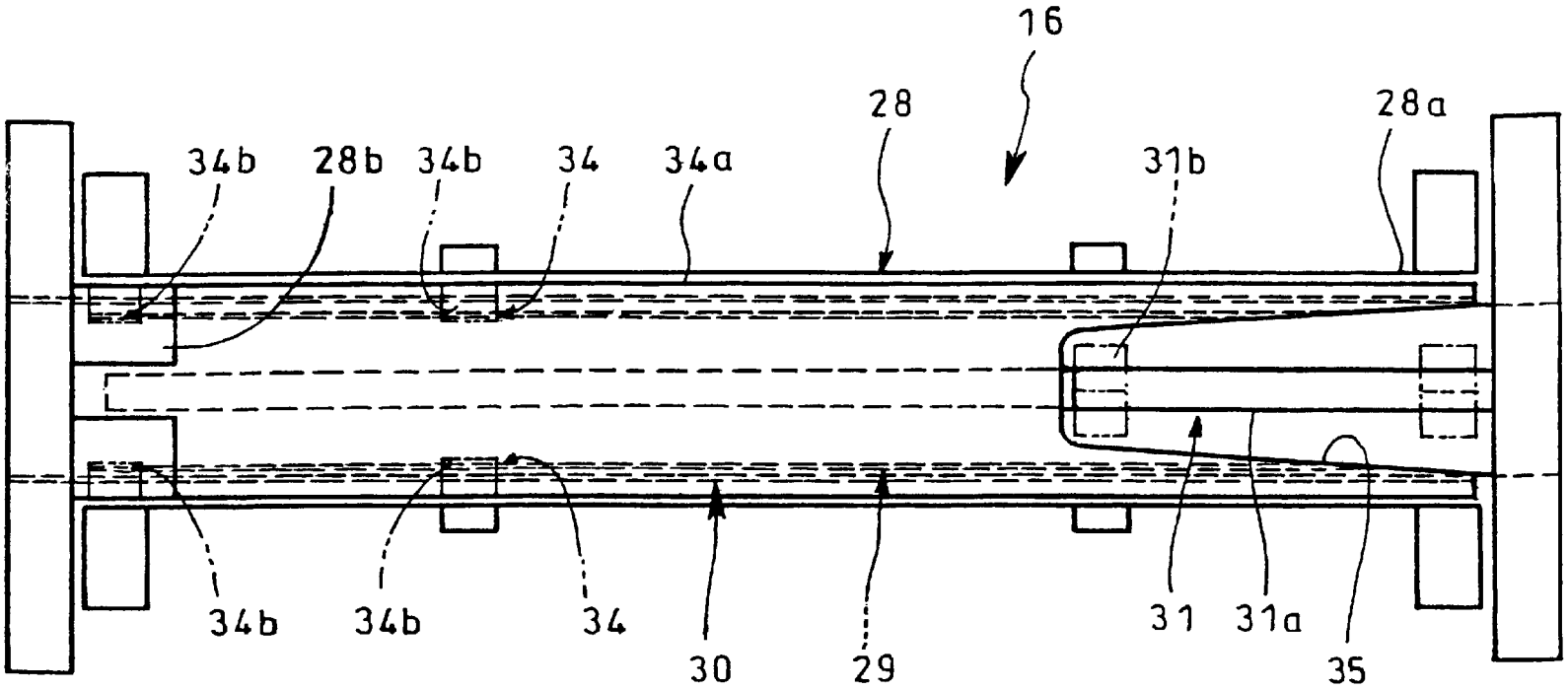
FIG. 7 is a plan view of FIG. 6.
Figure 8:
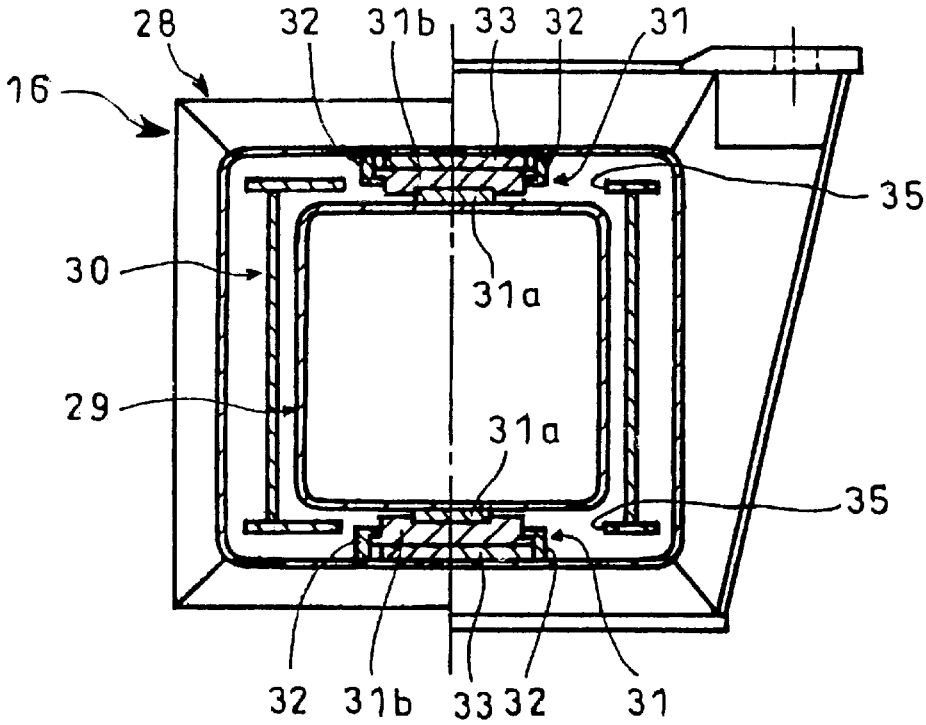
FIG. 8 is a view looking in the direction of arrows VIII in FIG. 6.
Figure 9:
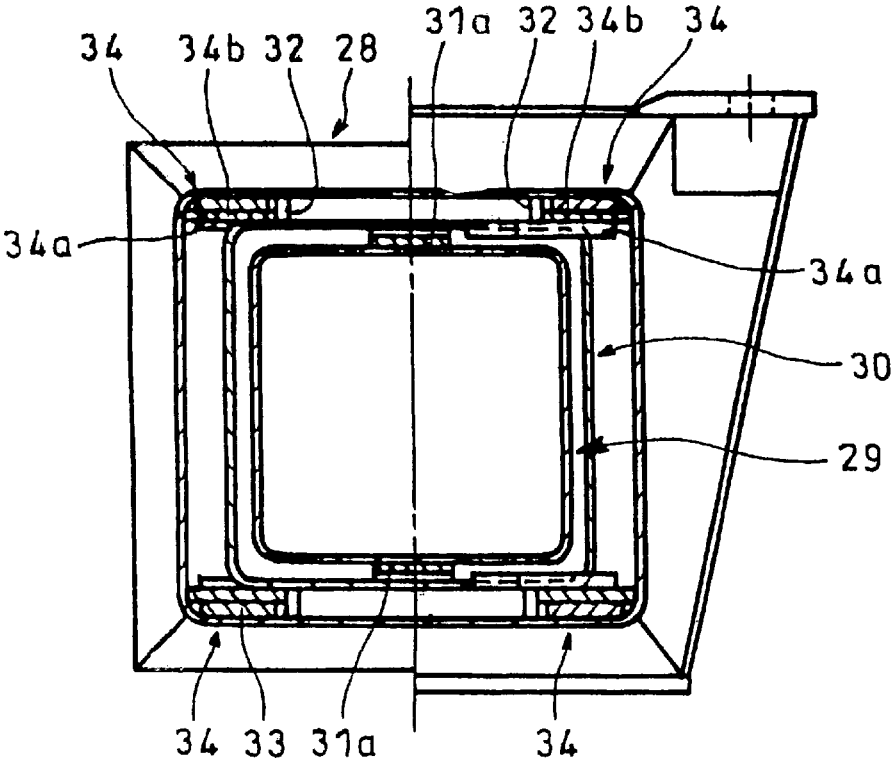
FIG. 9 is a view looking in the direction of arrows IX in FIG. 6.

FIGS. 6–9 show an embodiment of the invention in which FIG. 6 is a sectional front elevation of a spreader; FIG. 7 is a plan view of FIG. 6; FIG. 8 is a view looking in the direction of arrows VIII in FIG. 6; and FIG. 9 is a view looking in the direction of arrows IX in FIG. 6. A spreader 16, which is connected to a bottom of a head block 15 and is suspended from a trolley 9 for hoisting as shown in FIGS. 2 and 3, is constructed as mentioned below.

Figure 1:
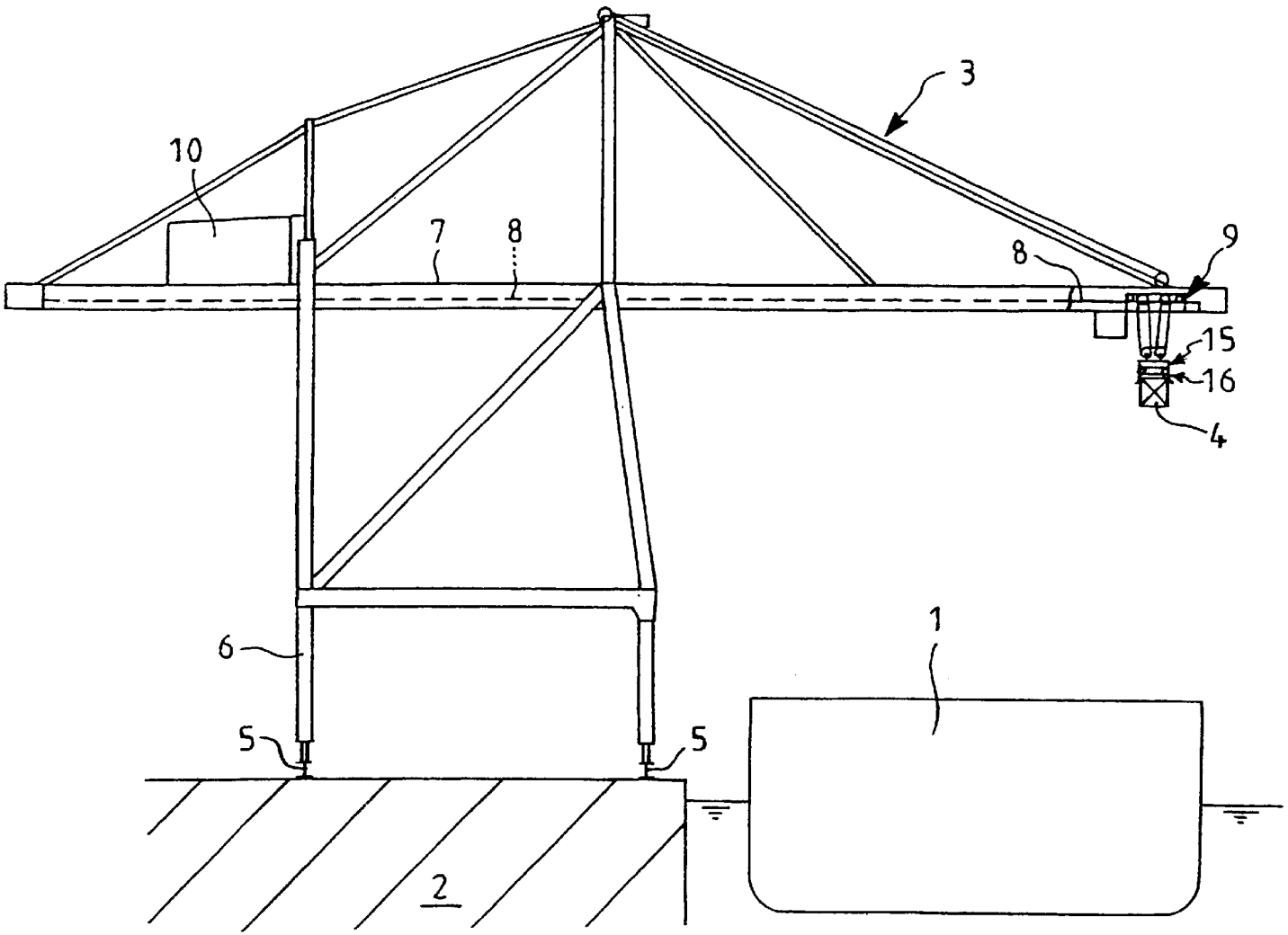
Fig. 1 BACKGROUND ART
FIG. 1 is a general schematic side elevation of a general container crane.
Figure 2:
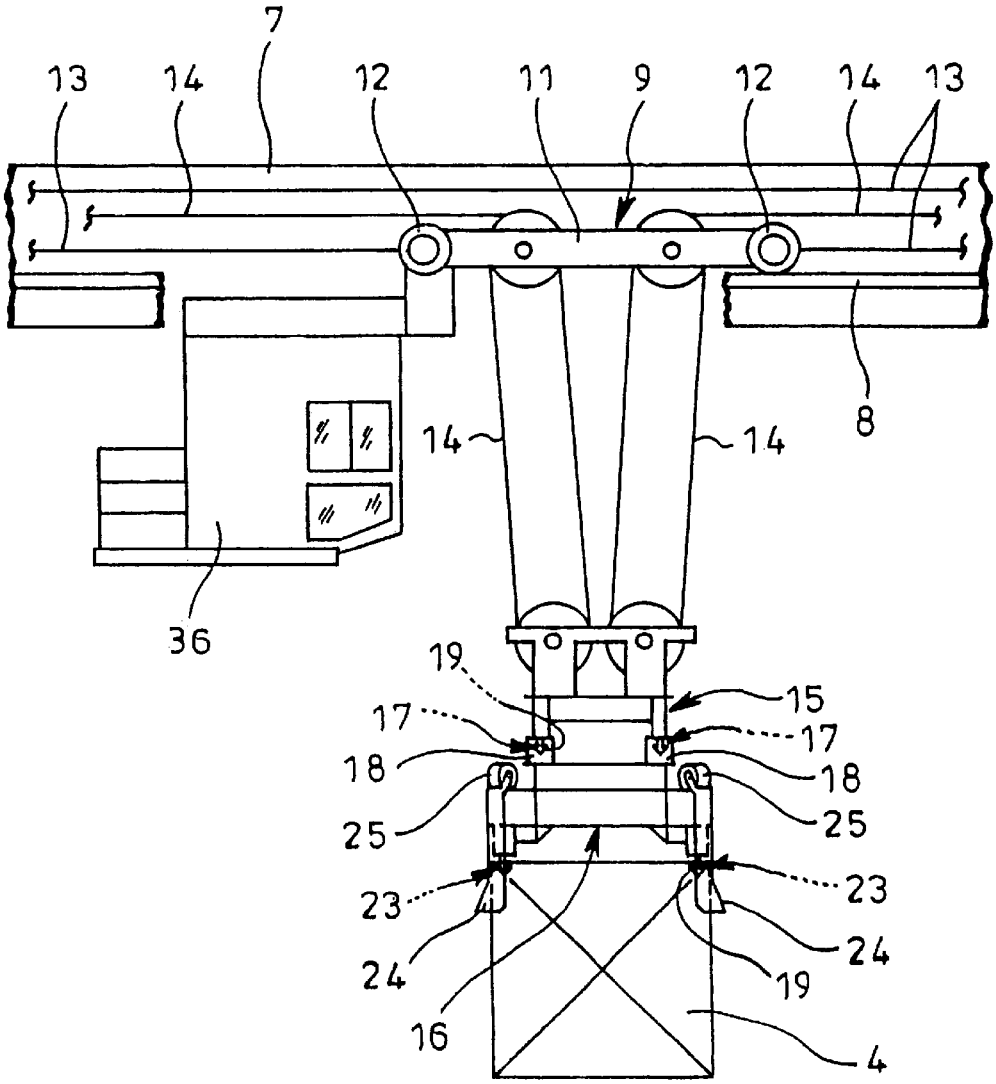
Fig. 2 BACKGROUND ART
FIG. 2 is a side elevation of a trolley and a spreader suspended by the trolley.
Figure 3:
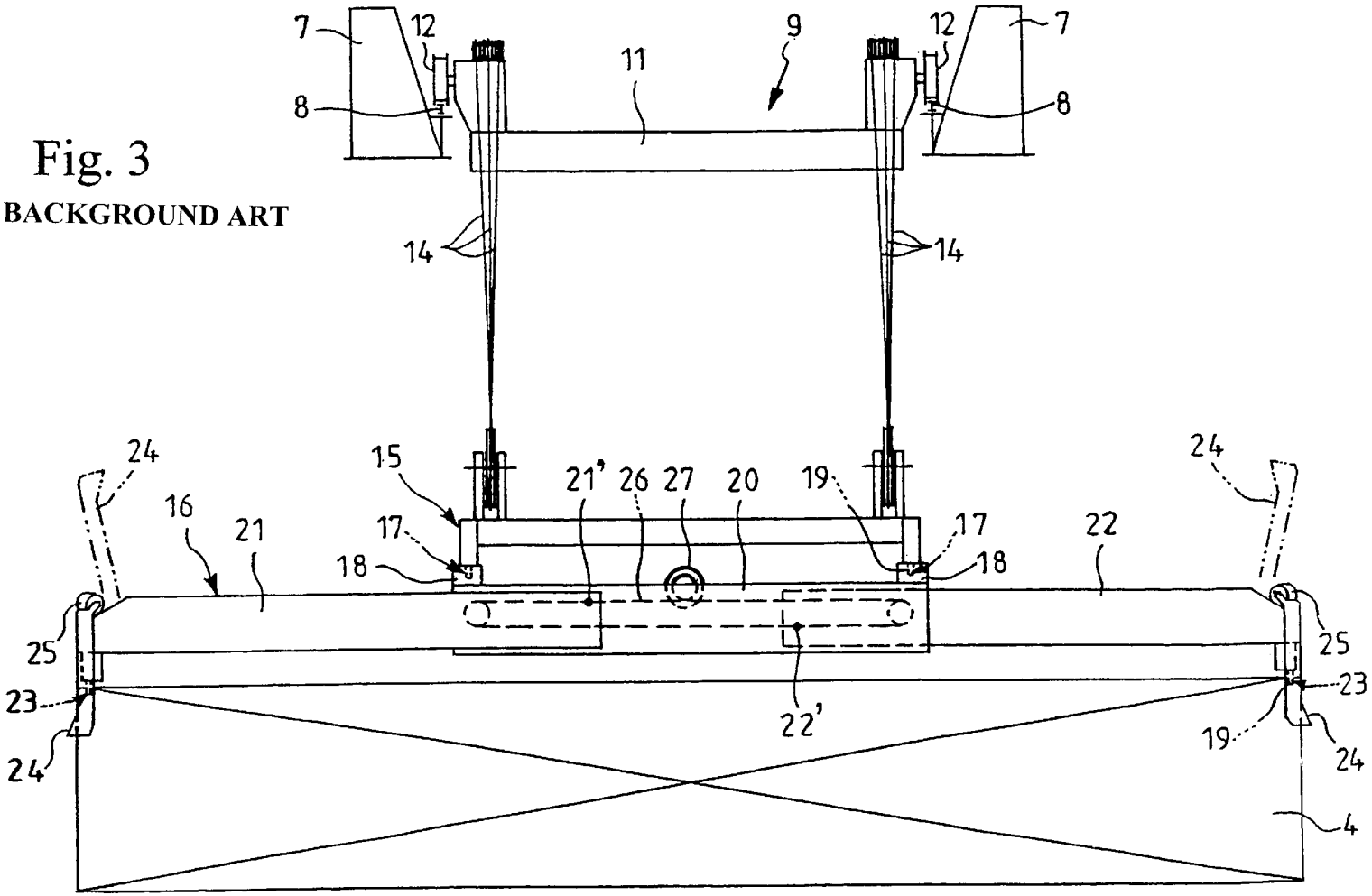
Fig. 3 BACKGROUND ART
FIG. 3 is a front elevation of FIG. 2.

In replace of the stationary frame 20 shown in FIGS. 2 and 3, a box body 28 with a box-shaped section is arranged as shown in FIGS. 6–9.

The box body 28 is provided with laterally extendable and contractible telescopic inner and outer box frames 29 and 30.

The telescopic inner box frame 29 is slidably supported in an end 28*a* (FIG. 7) of the box body 28 by inner supports 31 which are arranged above and below of a lateral axis.

The inner support 31 comprises an inner support rail 31*a* on an upper or lower surface of the inner box frame 29 above or below of the lateral axis and guide members 31*b* fixed to an inner surface of the box body 28 by fixing brackets 32 so as to face on the inner support rail 31*a*. Mutually facing slide faces of the inner support rail 31*a* and guide members 31*b* are processed by molybdenum sintering or the like to provide an oilless bearing. The inner support rail 31*a* extends substantially over the whole length of the inner box frame 29. The guide members 31*b* are two pieces one of which is positioned at the end 28*a* of the box body 28 and the other, at a predetermined position away from the end 28*a* toward the other end 28*b*. In FIGS. 8 and 9, reference numeral 33 denotes rubber or other cushioning members between the inner surface of the box body 28 and the guide members 31*b*.

The telescopic outer box frame 30 is supported in the other end 28*b* (FIG. 7) of the box body 28 by side supports 34 which are arranged above and below and symmetrically of the lateral axis as shown in FIG. 9.

The side support 34 comprises a side support rail 34*a* on a widthwise edge of the outer box frame 30 above or below of the lateral axis and guide members fixed to an inner surface of the box body 28 so as to face on the side support rail 34*a*. Mutually facing slide faces of the side support rail 34*a* and guide members 34*b* are processed by molybdenum sintering or the like to provide an oilless bearing. The side support rail 34*a* extends substantially over the whole length of the outer box frame 30. The guide members 34*b* are two pieces one of which is positioned at the other end 28*b* of the box body 28 and the other, at a predetermined position away from the other end 28*b* toward the end 28*a*. Also in this case, the rubber or other cushion members 33 are arranged between the inner surface of the box body 28 and the guide members 34*b*.

Moreover, each of a top and a bottom of the outer box frame 30 is formed, at its base end supported by the box body 28, with a notch 35 as shown in FIGS. 7 and 8 to prevent the outer box frame 30 from being interfered with the guide members 31 of the inner support 31 upon sliding extension or contraction of the box frames 29 and 30.

Next, mode of operation of the above-mentioned embodiment will be described.

According to the spreader 16 shown in FIGS. 6–9, since the box body 28 with the box-shaped section is provided with the laterally extendable and contractible telescopic inner and outer box frames 29 and 30, the box frames 29 and 30 can have bending rigidity drastically enhanced in comparison with the conventional spreaders. Because of the telescopic type, the inner and outer box frames 29 and 30 are aligned with each other in their lateral axes, thereby preventing twist load from being acted on the box frames 29 and 30 to thereby improve the strength of the spreader 16, relieve the possible problem of damages and prolong the service life of the spreader.

The telescopic inner box frame 29 is slidably supported in the end 28*a* of the box body 28 by the inner supports 31 above and below of its lateral axis; the outer box frame 30 is supported in the other end 28*b* of the box body 28 by the side supports 34 which are above and below and symmetrically of its lateral axis; and the notches 35 are formed on the top and the bottom of the outer box frame 30 at its base end supported by the box body 28 so as to prevent the outer box frame 30 from being interfered with the guide members 31*b* of the inner supports 31 upon sliding extension or contraction of the box frames 29 and 30. As a result, the inner and outer box frames 29 and 30 can be extended or contracted with greater stroke and without mutual interference.

The sectional shapes of the above-mentioned box body 28 and box frames 29 and 30 are not limited to those illustrated and may be varied variously; structures of the inner and side supports 31 and 34 may be also varied variously.

Figure 4:
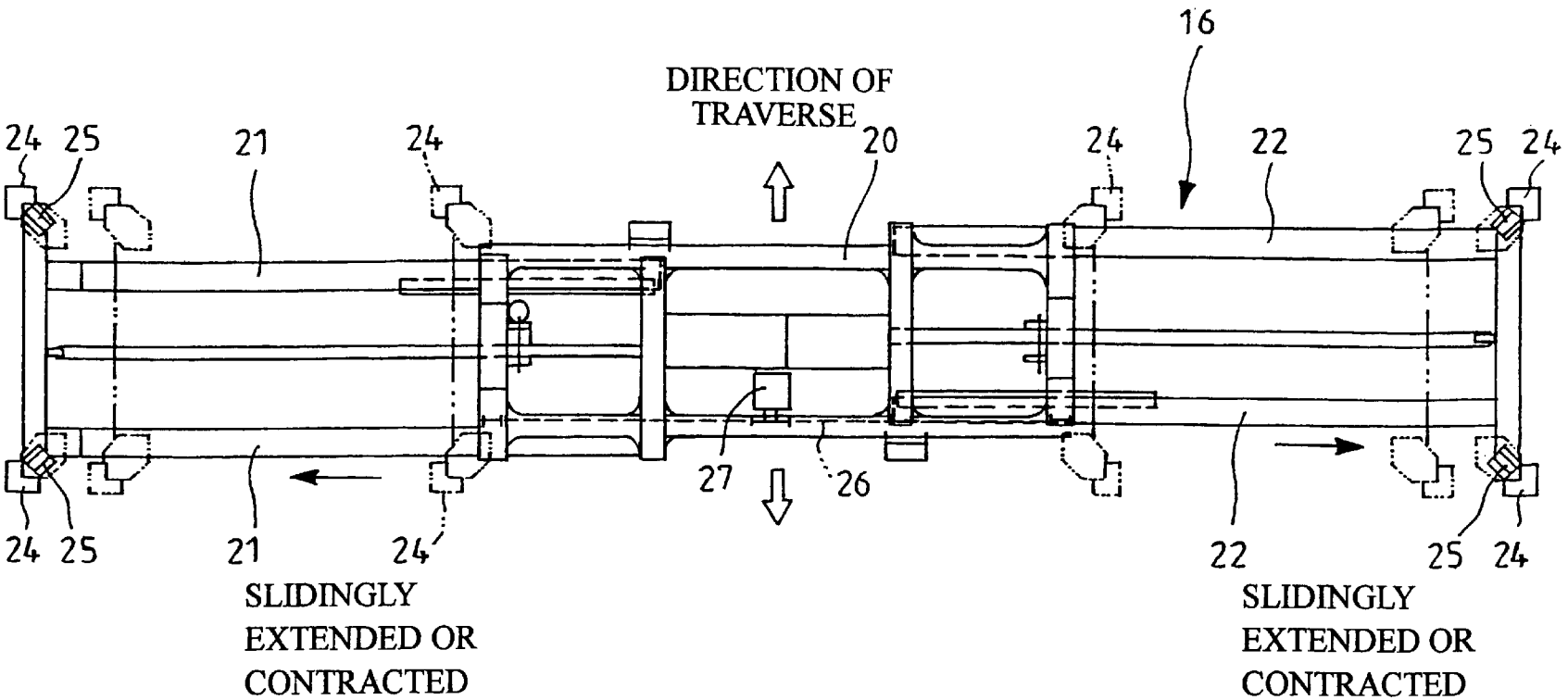
Fig. 4 BACKGROUND ART
FIG. 4 is a plan view of a conventional spreader.
Figure 10:
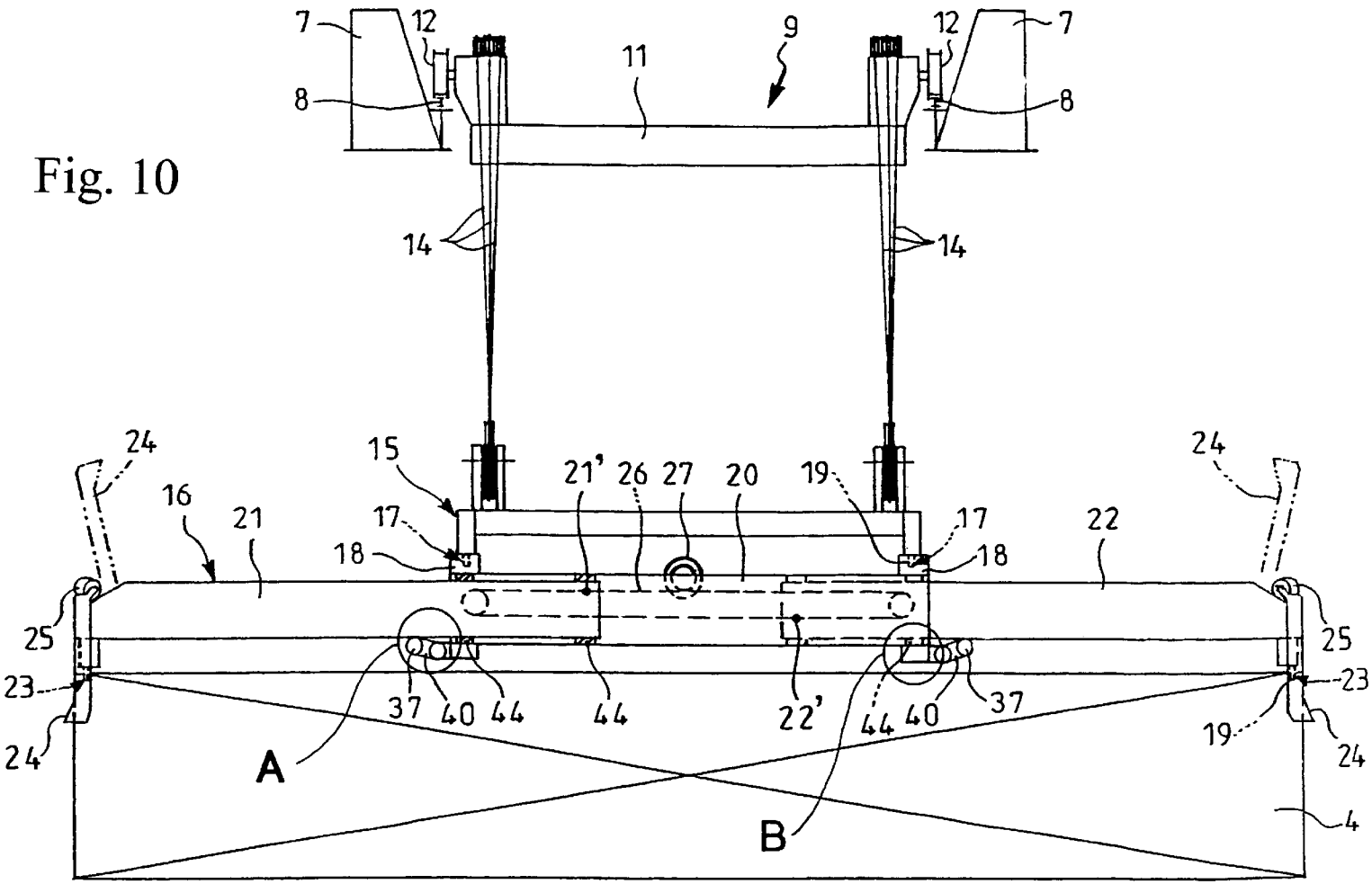
FIG. 10 is a front elevation of a further embodiment of a spreader according to the invention.
Figure 11:
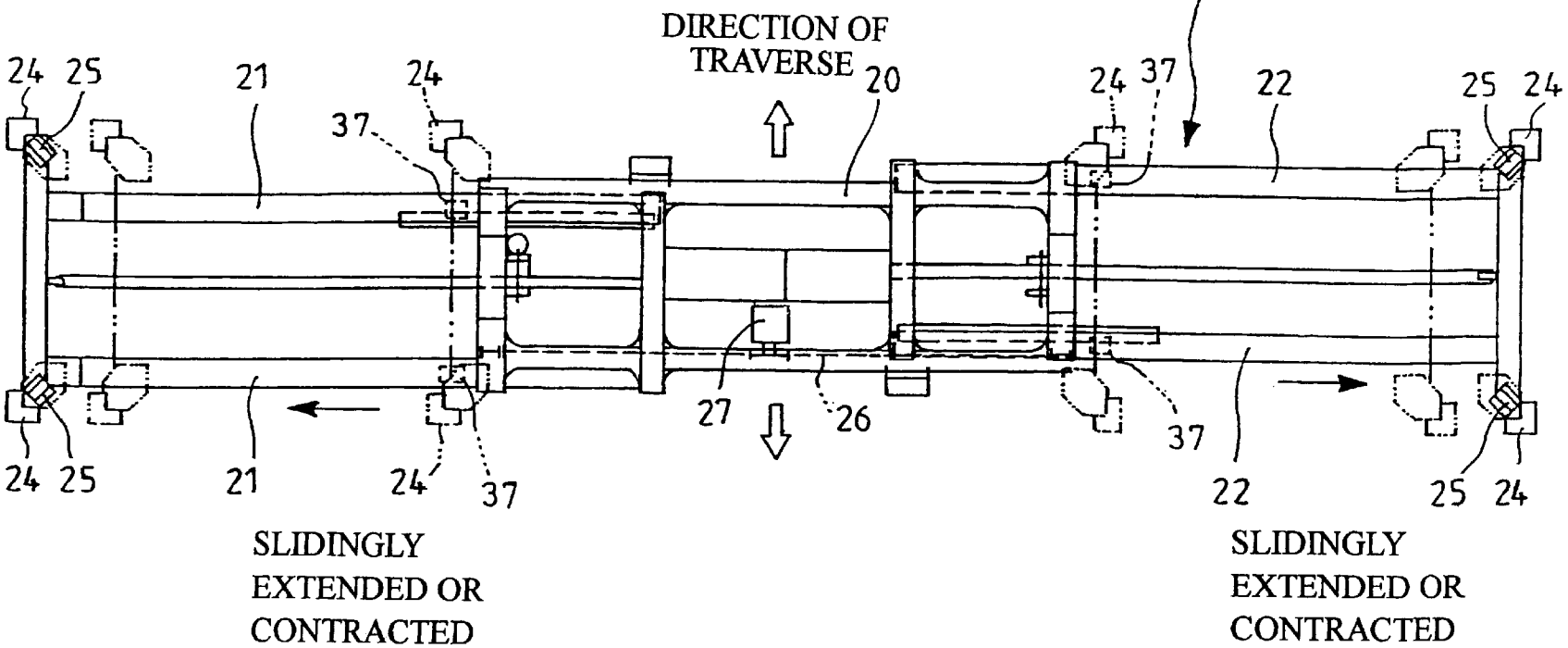
FIG. 11 is a plan view of FIG. 10.
Figure 12:
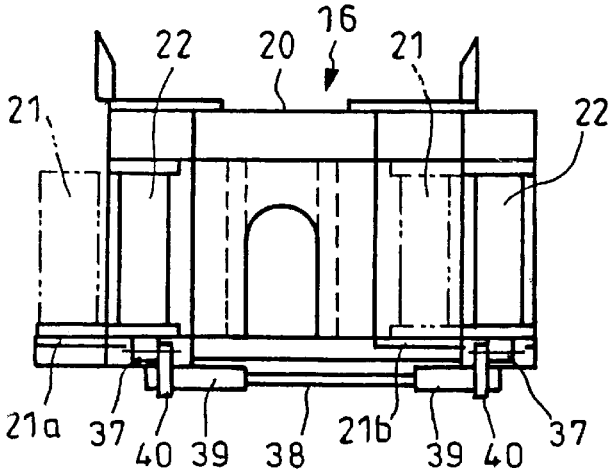
FIG. 12 is a side elevation of FIG. 10.

FIGS. 10–18 show further embodiments of the invention in which FIG. 10 is a view corresponding to FIG. 3 of the prior art; and FIGS. 11 and 12, FIG. 4 of the prior art.

Figure 5:
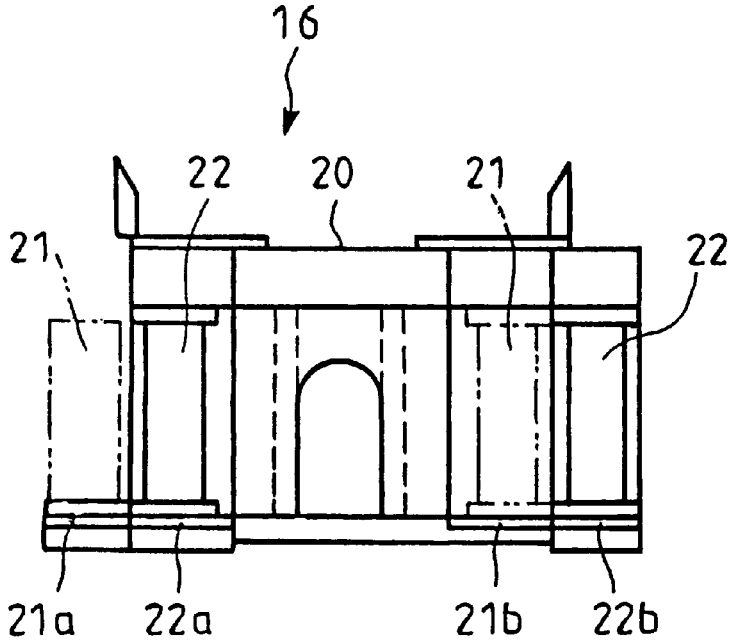
Fig. 5 BACKGROUND ART
FIG. 5 is a side elevation of the conventional spreader.
Figure 13:
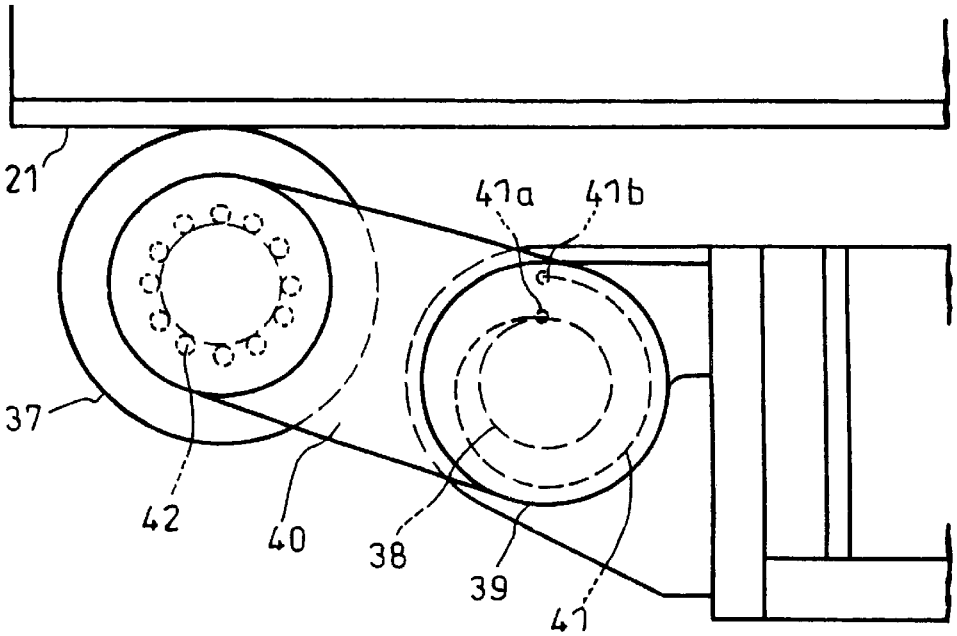
FIG. 13 is a detailed view of part A in FIG. 10.

FIG. 13 is a detailed view of part A in FIG. 10 and showing a mechanism for supporting the extension frames. The structure as mentioned below may be applicable to the conventional spreaders shown in FIGS. 3–5 as well as to the embodiment shown in FIGS. 6–9.

The stationary frame 20 of the spreader 16 shown in FIGS. 10–13 has lateral open ends each of which has at its lower portion a support roller 37 which in turn accommodates a bearing and serves for receiving load of the corresponding lateral extension frame 21 or 22. The support rollers 37 are arranged, as shown in FIG. 11, below the two extension frames 21 and 22, respectively.

As shown in FIG. 12, the stationary frame 20 is provided at its bottom with a stationary shaft 38 which extends widthwise of the stationary frame 20 and which has rotatable shafts 39 at its opposite ends. Fixed to the rotatable shaft 39 is an end of an arm 40 which has the other end on which in turn the support roller 37 is mounted.

As shown in FIG. 13, the rotatable shaft 39 has a helical spring 41 one end 41*a* of which is fixed to the stationary shaft 38 and the other end of which is fixed to the rotatable shaft 39 (the arm 40). The helical spring 41 urges the arm 40 upwardly (clockwise in FIG. 13) to press the support roller 37 to the bottom of the extension frame 21 or 22. As mentioned previously, the support roller 37 has at its inner periphery a bearing 42.

The helical spring 41 is set to have urging force such that the support roller 37 can push the extension frame 21 or 22 and support the load of the extension frame upon extension or contraction of the latter and that the support roller 37 and the free end of the arm 40 can escape downwardly when load of the container 4 is applied to the extension frame 21 or 22.

In the embodiment shown in FIGS. 10–13, upon extension or contraction of the extension frames 21 and 22, the support rollers 37 are rolled in support of load of the extension frames 21 and 22 and therefore only rolling friction is generated between them; as a result, the extension frames 21 and 22 can be driven by a drive force which is by far smaller than that in the prior art. Thus, a drive 27 for driving the extension frames 21 and 22 may be of a smaller rating, resulting in reduction of the cost.

As shown in FIGS. 12 and 13, according to the embodiment, the rotatable shaft 39 is in a fixed relationship with the arm 40 and is rotated about the stationary shaft 38 so that the arm 40 is pivotable clockwise and counterclockwise. Alternatively, the arm 40 may be directly pivoted to the stationary frame 20 for pivotal movement of the arm.

Means used for upward urging of the arm 40 is the helical spring 41; alternatively, a torsion bar, a blade spring or the like may be used.

Figure 14:
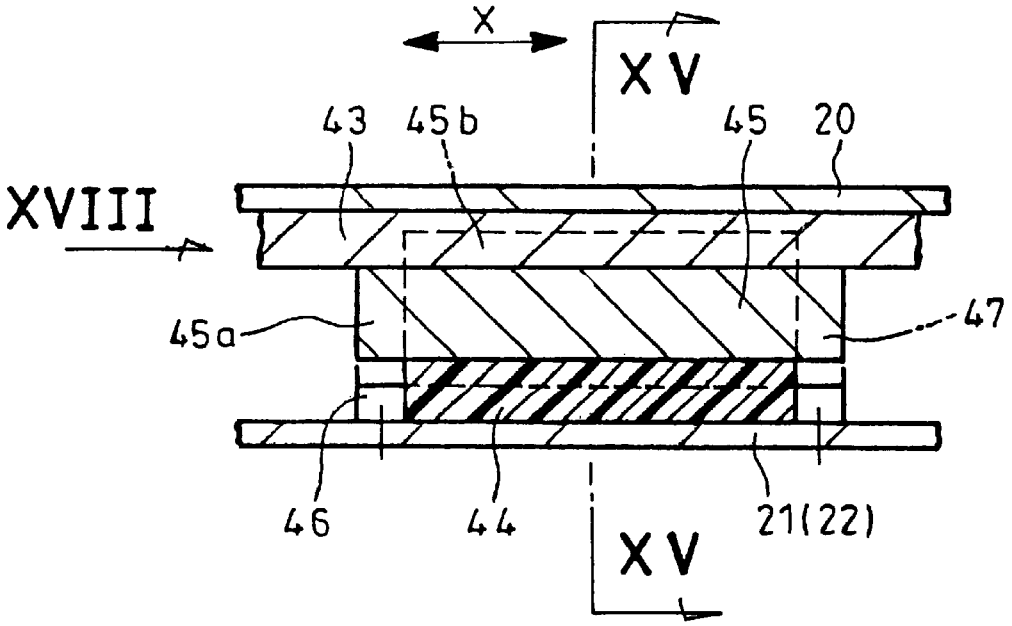
FIG. 14 is a detailed sectional view of part B in FIG. 10 and shows a still further embodiment of a spreader according to the invention.
Figure 15:
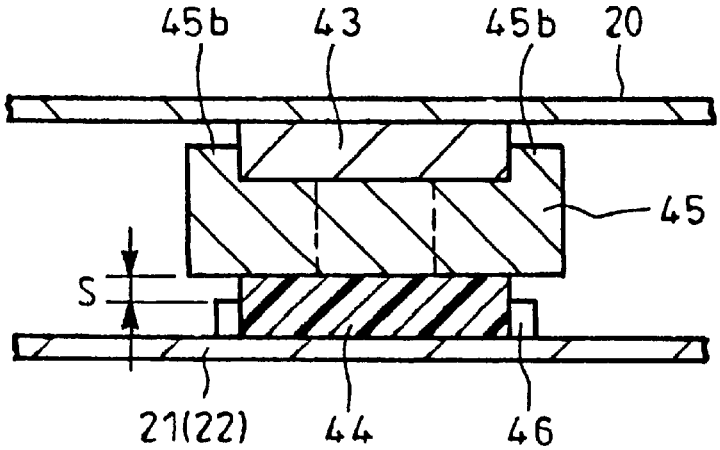
FIG. 15 is a view looking in the direction of arrows XV in FIG. 14.
Figure 16:
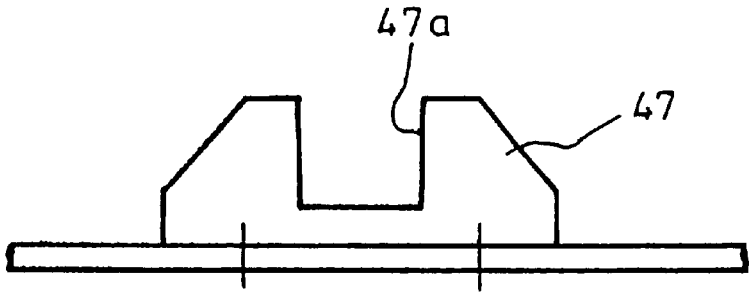
FIG. 16 is a front elevation of a positioning stopper.
Figure 17:
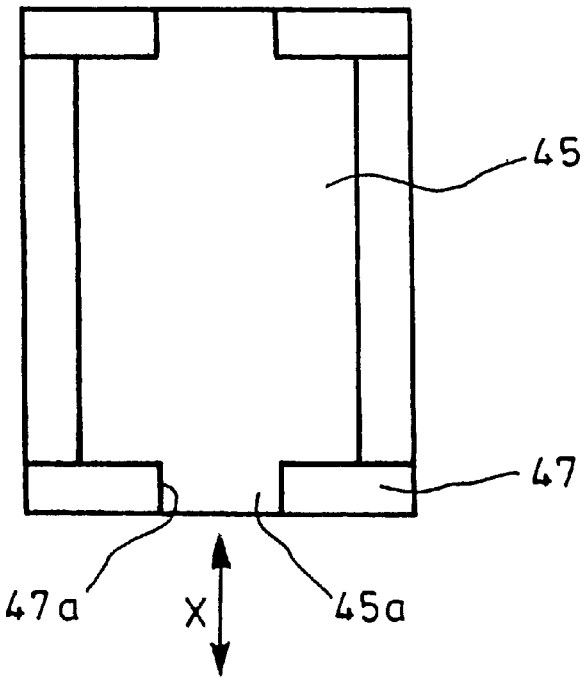
FIG. 17 is a plan view showing a slide fitting engaged with the positioning stoppers.
Figure 18:
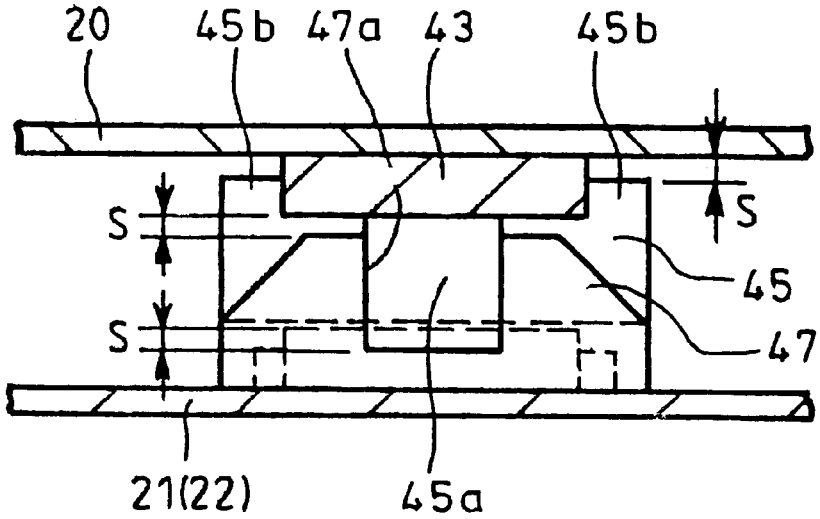
FIG. 18 is a view looking in the direction of arrows XVIII in FIG. 14.

FIG. 14 is a detailed view showing in larger scale part B of FIG. 10; FIG. 15 is a view looking in the direction of arrows XV in FIG. 14; FIG. 16 is a front view of the positioning stopper; FIG. 17 is a plan view showing slide fitting engaged with the positioning stoppers; and FIG. 18 is a view looking in the direction of arrows XVIII in FIG. 14.

In a spreader 16 shown in FIGS. 14–18, a stationary frame 20 has longitudinally extending rails 43 respectively on its upper and lower inner surfaces (only the upper inner surface being shown in FIGS. 14 and 15) facing to the extension frame 21 (22). A surface of the extension frame 21 (22) facing to the stationary frame 20 has a rubber or other cushioning member 44 and a slide fitting 45.

The cushioning member 44 is immobilized by stoppers 46 lower in height than the cushioning member 44 so as not to be displaced in the direction of extension and contraction.

The slide fitting 45 is fitted over the rail 43 such that, as shown in FIG. 15, the rail 43 is clamped at its opposite ends (widthwise ends perpendicular to the direction of extension and contraction) by projections 45*b*. Provided at opposite ends (left and right ends in FIG. 14), in the direction X of extension and contraction of the extension frames 21 and 22, of the cushioning member 44 and slide fitting 45 are positioning stoppers 47 as shown in FIG. 16. These positioning stoppers 47 are bolted to the extension frame 21 (22).

As shown in FIG. 16, an upper center of the positioning stopper 47 is formed with an engaging groove 47*a*. Each of longitudinal ends of the slide fitting 45 is formed at its widthwise center (or its center in the direction of perpendicular to the longitudinal direction) with a positioning projection 45*a* which is engaged with the engaging groove 47*a*.

As shown in FIGS. 14 and 17, the positions of the cushioning member 44 and slide fitting 45 in the direction X of extension and contraction are confined by the engaged positioning stoppers 47. Deviation of the slide fitting 45 in the widthwise direction perpendicular to the direction of extension and contraction is confined by upright surfaces of the engaging groove 47*a* as shown in FIG. 18.

Gaps S are respectively provided between the projection 45*b* and the stationary frame 20, between the upper end of the positioning stopper and the rail 43, between the lower surface of the projection 45*a* and the engaging groove 47*a* and between the upper end of the stopper 46 and the lower surface of the slide fitting 45 so that the cushioning member 44 may be compressed within the range of the gaps S when the slide fitting 45 is loaded or burdened.

In FIGS. 10 and 14–18, the slide fitting 45 is displaced in unison with the lateral extension frame 21 or 22 through guidance of the rail 43 when the extension frame 21 or 22 is extended or contracted.

When the container 4 is to be loaded on the container ship 3 using the container crane 3, firstly the spreader 16 interlocked with the head block 15 from the trolley 9 is hoisted down onto the container 4; in this case, as mentioned previously, the spreader 16 is collided against and rested on the container 4.

Therefore, heavy weight of the head block 15 and spreader 16 acts on the extension frames 21 and 22 upon collision; such collision force may be absorbed by the cushioning member 44. Moreover, the cushioning member 44 can also prevent generation of the cantilever relationship which may be caused depending upon machining accuracy of the load-acting portion and which may damage the spreader 16.

The stationary frame is in the form of a box body by which mutually telescopic lateral extension frames are slidably supported, thereby providing a spreader which is light in weight and has no bent or torsion of the extension frames. Support of the extension frame by the support rollers mounted on the opposite ends of the stationary frame reduces the drive force upon extension or contraction of the extension frames. Provision of the rail and the cushioning member between the extension frames and stationary frame suitably reduces the impact load applied on the extension frames when the spreader is hoisted down onto the container.

What is claimed is:

1. A spreader for a container crane comprising:

a stationary frame suspended by a trolley; and extension frames mounted on the stationary frame so as to be laterally extendable and contractile depending upon a length of a container, the stationary frame having open ends, each of the open ends of the stationary frame having a support roller at lower portions thereof, each of the support rollers accommodating a bearing and supporting a load of one of the extension frames, each of the support rollers being rotatably supported by an arm, each of the arms having a first end pivotally supported by the stationary frame and a second end, which is an open end, rotatably supporting one of the support rollers, each of the arms being provided with an urging means for supporting a load of one of the extension frames and affording an upward urging force such that an associated one of the support rollers may escape downwardly due to a load of the container.

* * * * *